United States Patent [19]

Iacobelli

[11] 4,015,163

[45] Mar. 29, 1977

[54] ORNAMENTAL DEVICE

[76] Inventor: Michael D. Iacobelli, 565 Morse Road, Apt. 104, Troy, Mich. 48084

[22] Filed: June 12, 1975

[21] Appl. No.: 586,250

[52] U.S. Cl. ..... 312/223; 312/238; 312/345; 312/204

[51] Int. Cl.[2] ..... A47B 77/08

[58] Field of Search ..... 312/238 T, 223, 204; 248/345

[56] References Cited

UNITED STATES PATENTS

| | | | |
|---|---|---|---|
| 560,288 | 5/1896 | Vickers | 312/238 |
| 1,819,721 | 8/1931 | Stone | 312/238 |
| 2,768,045 | 10/1956 | Dietrich | 312/238 X |
| 2,967,929 | 1/1961 | Wolar | 248/345 |
| 3,606,229 | 9/1971 | Wall | 248/345 |
| D148,940 | 3/1948 | Motter | 312/238 |

*Primary Examiner*—Kenneth Downey
*Attorney, Agent, or Firm*—William L. Fisher

[57] ABSTRACT

Improvement in an ornamental device for ornamenting a room having a light source therefor comprising joined together front and opposite side members, the side members projecting from the rear face of the front member and an arrangement for attaching the device to a corner of the room formed by the junction of a wall and a ceiling thereof so that the light source and one device covers the edge of the front and side members press against the ceiling and another edge thereof presses against the wall, the attaching arrangement being a yieldable member arranged to pull upon the rear face so as to pull the device inwardly toward the corner, the members each having at least one translucent panel therein for passing light from the source therethrough from inside the device to the outside thereof, whereby to decoratively affect the illumination of said room.

4 Claims, 5 Drawing Figures

ORNAMENTAL DEVICE

My invention relates to ornamenting rooms.

The principal object of my invention is to provide an improved ornamental device and method of ornamenting a room.

Figure 5:
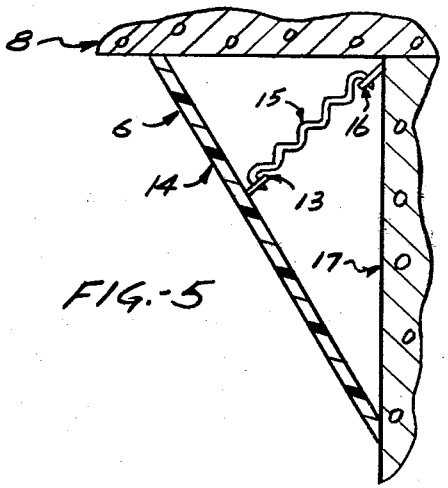
Figure 4:
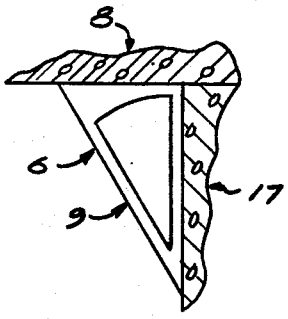
Figure 2:
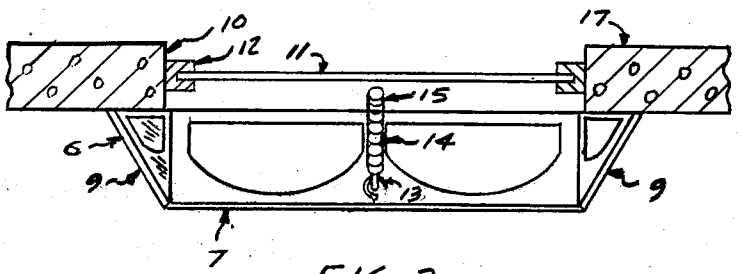
Figure 1:
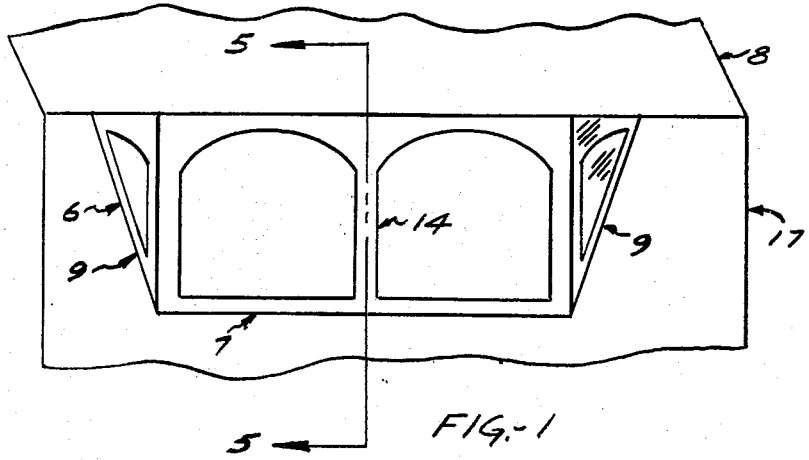
Figure 3:
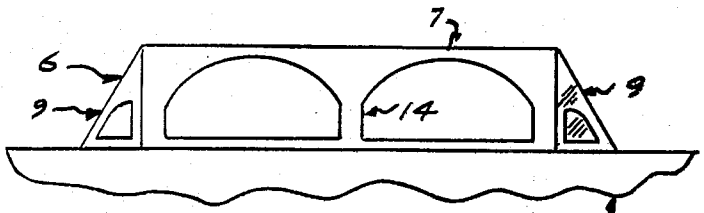

The foregoing object of my invention and the advantages thereof will become apparent during the course of the following description, taken in conjunction with the accompanying drawings, in which:

FIGS. 1–4 are, respectively, front elevational, top plan (with parts in section), bottom plan and side elevational (with parts in section) views of an ornamental room cabinet embodying my invention; and FIG. 5 is a vertical sectional view of the structure of FIG. 1 taken on the line 5—5 thereof.

Referring to the drawings in greater detail, 6 generally designates an ornamental device shown in use in a room which has a ceiling 8 and a wall 17. Said device 6 is shown in place in a corner of said room formed by the junction of said ceiling 8 and wall 17. In the instance, the wall 17 is a basement wall having a window opening 10 therein and a window sash 12 (having a window pane 11 therein) in said opening 10 and the ceiling 8 is a basement ceiling.

Said device 6 comprises a rectangular front member 7 having a pair of translucent panels therein and triangular side members 9 attached to opposite ends of said front member 7. Said side members 9 have translucent panels therein and extend rearwardly of the rear face of said front member 7 at obtuse angles thereto. Said side members 9 have free right-angled corners which engage with and conform to said room corner. Said device 6 has means for attaching itself to said room corner comprising a tension spring 15 and hooks 13 and 16 fastened, respectively, to the center bar 14 of said front member 7 and to said wall 17 near said room corner. Said spring 15 has its opposite ends fastened to said hooks 13 and 16 to pull said device 6 against said corner. Said front member 7 has a horizontal top edge and said side members 9 have horizontal top edges which engage flush against the ceiling 8. Said front member 7 has a vertical bottom edge and said side members 9 have vertical side edges which engage flush against the wall 17. The device 6 is a decorative cover for what it otherwise a relatively unsightly basement window 12 and the four translucent panels diffuse sunlight coming through said basement window pane 11 so that said device also decoratively affects the illumination of said room. Said device 6 can also be used to cover an artificial light and decoratively affects the illumination of said room.

It will thus be seen that there has been provided by my invention improvements in ornamenting a room in which the advantages hereinabove set forth, together with many thoroughly practical advantages, have been successfully achieved. While a preferred embodiment of my invention has been shown and described, it is to be understood that variations and changes may be resorted to without departing from the spirit of my invention, as defined by the appended claims.

What I claim is:

1. Improvement in an ornamental device for ornamenting a room having a light source therefor comprising joined together front and opposite side members, said side members projecting rearwardly from the rear face of said front member and means for attaching said device to a corner of said room formed by the junction of a wall and a ceiling thereof so that said device covers said light source and one edge of said front and side members presses against said ceiling and another edge thereof presses against said wall, said attaching means being yieldable means arranged to pull upon said rear face so as to pull said device inwardly toward said corner, said device having at least one translucent panel therein for passing light from said source therethrough from inside said device to the outside thereof, whereby to decoratively affect the illumination of said room.

2. Improved ornamental device as claimed in claim 1, each said side member disposed at an obtuse angle with respect to said front member.

3. Improved ornamental device as claimed in claim 2, said front member being a rectangular member, and said side members being triangular members having right-angled free corners.

4. Improved ornamental device as claimed in claim 1, each said side member having a right angled free corner to fit into a right angled room corner formed by said wall and ceiling.

* * * * *

UNITED STATES PATENT OFFICE

CERTIFICATE OF CORRECTION

Patent No. 4,015,163 Dated March 29, 1977

Inventor(s) Michael D. Iacobelli

It is certified that error appears in the above-identified patent and that said Letters Patent are hereby corrected as shown below:

In the Abstract, lines 7 and 8 should read:
and a ceiling thereof so that the device covers the light source and one edge of the front and side members --.

Column 2, line 1, "it" should read -- is --.

This certificate supersedes Certificate of Correction issued May 31, 1977.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*